US007131222B1

(12) United States Patent
Glenn

(10) Patent No.: US 7,131,222 B1
(45) Date of Patent: Nov. 7, 2006

(54) IRONING BOARD AND CONTAINER SUPPORT ENSEMBLE

(75) Inventor: James L. Glenn, Franklin County, MO (US)

(73) Assignee: Whitney Design, Inc., Bridgeton, MO (US)

( * ) Notice: Subject to any disclaimer, the term of this patent is extended or adjusted under 35 U.S.C. 154(b) by 0 days.

(21) Appl. No.: 11/104,680

(22) Filed: Apr. 13, 2005

(51) Int. Cl.
*D06F 81/00* (2006.01)
*D06F 81/02* (2006.01)

(52) U.S. Cl. ..... 38/106; 38/111

(58) Field of Classification Search ..... 38/103, 38/104, 106, 107, 111, 137; 493/311, 939; D32/37; 248/95; 206/386
See application file for complete search history.

(56) References Cited

U.S. PATENT DOCUMENTS

| | | | | |
|---|---|---|---|---|
| 442,507 | A | 12/1890 | Benton | |
| 606,210 | A | 6/1898 | Harriman | |
| 702,242 | A * | 6/1902 | ONeil | 38/111 |
| 747,615 | A * | 12/1903 | Krabach | 38/111 |
| 930,491 | A | 8/1909 | Peterman | |
| 982,093 | A | 1/1911 | Russ | |
| 1,558,268 | A | 10/1925 | Mast | |
| 1,583,233 | A | 5/1926 | Leon | |
| 1,642,643 | A * | 9/1927 | Carruth | 220/9.1 |
| 1,723,796 | A | 8/1929 | Magnuson | |
| 1,897,081 | A * | 2/1933 | Sorensen | 38/111 |
| 2,078,587 | A | 4/1937 | Sadenwater | |
| 2,276,981 | A | 3/1942 | John | |
| 2,313,135 | A | 3/1943 | Fay | |
| 2,406,050 | A | 9/1946 | Tronic | |
| 2,424,734 | A | 7/1947 | Booth | |
| 2,451,259 | A | 10/1948 | Tronic | |
| 2,506,479 | A * | 5/1950 | Zelzer | 38/111 |
| 2,564,627 | A * | 8/1951 | Rauscher | 38/111 |
| 2,603,012 | A | 7/1952 | Geddes et al. | |
| 2,617,213 | A | 11/1952 | Smith | |
| 2,718,077 | A | 9/1955 | Grissette | |
| 2,748,512 | A | 6/1956 | Kulicke, Jr. | |
| 2,864,187 | A | 12/1958 | Radliff | |
| 2,913,839 | A | 11/1959 | Ashby | |
| 2,974,431 | A | 3/1961 | Ribaudo | |
| 2,994,144 | A | 8/1961 | Pavlo | |
| 3,049,825 | A | 8/1962 | Boyd | |
| 3,152,561 | A | 10/1964 | Munson et al. | |
| 3,203,373 | A | 8/1965 | King | |

(Continued)

FOREIGN PATENT DOCUMENTS

| | | |
|---|---|---|
| FR | 1276320 | 3/1962 |

(Continued)

*Primary Examiner*—Ismael Izaguirre
(74) *Attorney, Agent, or Firm*—Polster, Lieder, Woodruff & Lucchesi L.C.

(57) ABSTRACT

An ironing table and container support ensemble comprises an ironing board movably mounted to leg stands to support the board in a first working position for ironing items on the board and fold with the board to a second folded position. A support movably mounts relative to the leg stands and to the board so that the support moves between a first position beneath the board and a second position to be closer to the board. A container secured to the support has a wall structure that forms a chamber for containing items in a first extended position. In a second position, the container structure occupies less space than in the first container position. The container having a shape and size to rest upon the support when the support and board are in their first positions to place items within the container.

45 Claims, 9 Drawing Sheets

U.S. PATENT DOCUMENTS

| | | | | | |
|---|---|---|---|---|---|
| 3,288,090 | A | | 11/1966 | King | |
| 3,433,954 | A | | 3/1969 | Michalski | |
| 4,769,894 | A | | 9/1988 | Simpson | |
| 5,335,432 | A | | 8/1994 | Simpson | |
| 5,446,930 | A | * | 9/1995 | Clark | 4/599 |
| 5,572,811 | A | * | 11/1996 | Lehrman | 38/106 |
| 5,881,975 | A | * | 3/1999 | Bianco | 248/95 |
| 6,014,827 | A | * | 1/2000 | Lehrman | 38/104 |
| 6,080,096 | A | * | 6/2000 | Becker et al. | 493/311 |
| 6,811,027 | B1 | * | 11/2004 | Alexander | 206/386 |

FOREIGN PATENT DOCUMENTS

| | | |
|---|---|---|
| GB | 801104 | 12/1956 |

* cited by examiner

IRONING BOARD AND CONTAINER SUPPORT ENSEMBLE

CROSS REFERENCE TO RELATED APPLICATIONS

None

STATEMENT REGARDING FEDERALLY SPONSORED RESEARCH OR DEVELOPMENT

Not Applicable

BACKGROUND OF THE INVENTION

This invention relates to ironing boards for use with an iron to iron clothes, and to containers for holding ironing board accessories or clothes. Ironing board assemblies have been used over the years for ironing clothes. Such ironing board assemblies have comprised an ironing board having leg stands, which position the board in a generally horizontal operating position relative to the floor board or floor. The leg stands are movably connected to themselves and movably mounted to the ironing board, so that the ironing board assembly can be repositioned to a collapsed position for movement to another location or for storage. The leg stands used with such ironing board assemblies have taken a variety of constructions, but typically have been comprised of tubular members. Such stands have included those comprising a pair of leg tubes, such as shown in U.S. Pat. No. 4,769,894, issued Sep. 13, 1988, and U.S. Pat. No. 5,335,432, issued Aug. 9, 1994, both with named inventor Danny Simpson. Prior art ironing board assemblies have also comprised leg stands having single tube leg stands, such as illustrated in U.S. Pat. No. 2,974,431, issued Mar. 14, 1961, with named inventor Tony Ribaudo; U.S. Pat. No. 2,913,839, issued Nov. 24, 1959, with named inventor Ernest V. A. Ashby; U.S. Pat. No. 3,152,561, issued Oct. 13, 1964, with named inventor D. J. Munson, et al.; and U.S. Pat. No. 2,748,512, issued Jun. 5, 1956, with named inventor Frederick W. Kulicke, Jr.

Various types of assemblies have been used in the prior art to lock the position of the ironing board relative to the leg stands, to hold the ironing board in a horizontal position, such as the locking assemblies in the aforesaid U.S. Pat. Nos. 4,769,894 and 5,335,432.

Prior art ironing board assemblies have also included shelves movably mounted relative to leg stands, which can be located beneath the ironing board. These have included shelves pivotally mounted relative to one of the leg stands. In the prior art containers have also been used to hold laundry accessories such as starch or sprinkle bottles, as well as to hold sprinkled clothes for ironing. Such prior art containers have included collapsible containers.

However, there has been a need for an ironing table assembly wherein a collapsible container can rest on a support beneath the board to be used in normal operation to hold accessories or clothes, which container can be detachably mounted to the support to be used at a location spaced away from the ironing table, but can also remain mounted to the support as the support board and legs are folded for storage or relocation.

SUMMARY OF THE INVENTION

The ironing table and container support ensemble of the present invention comprises an ironing table having an ironing board mounted upon movable legs with a locking mechanism to hold the ironing board in operating position. The ensemble further comprises a container support, which is movably mounted relative to the legs and a collapsible container. The container has a fastening subassembly that allows it to be detachably secured to the support. The ensemble can be placed in a first position wherein the ironing board is positioned for use, with the container support situated to support the container. In this first position, the container can be extended to a first position in which its compartment chamber is in a first extended and larger volume position to receive and contain articles such as clothing, starch, water for sprinkling, and the like. The container is configured so that it can collapse to a second position wherein it occupies a lesser amount of volume or space. In the ensemble's first position, the fastening subassembly can be easily disengaged and the container removed from the support and positioned elsewhere, such as on a table or chest.

The container can be moved to a second position to occupy less volume than in its first position, while remaining attached to the container support. In its said second position, the container then can move with the support as the ironing table ensemble is folded upon itself, such as to be stored or moved to another location, for example. During such folding, the container moves with the support as the support, ironing board and legs are moved closer together to a folded position. Thus, when the ensemble is in such folded position, the container occupies less space and can be conveniently and expeditiously stored or relocated as part of the ironing table ensemble. The container can be configured so that it provides rigidity in its extended first position, with structure to allow it to collapse to its second position easily with the exertion of little force.

DESCRIPTION OF PREFERRED EMBODIMENT

General Overview

Figure 1:
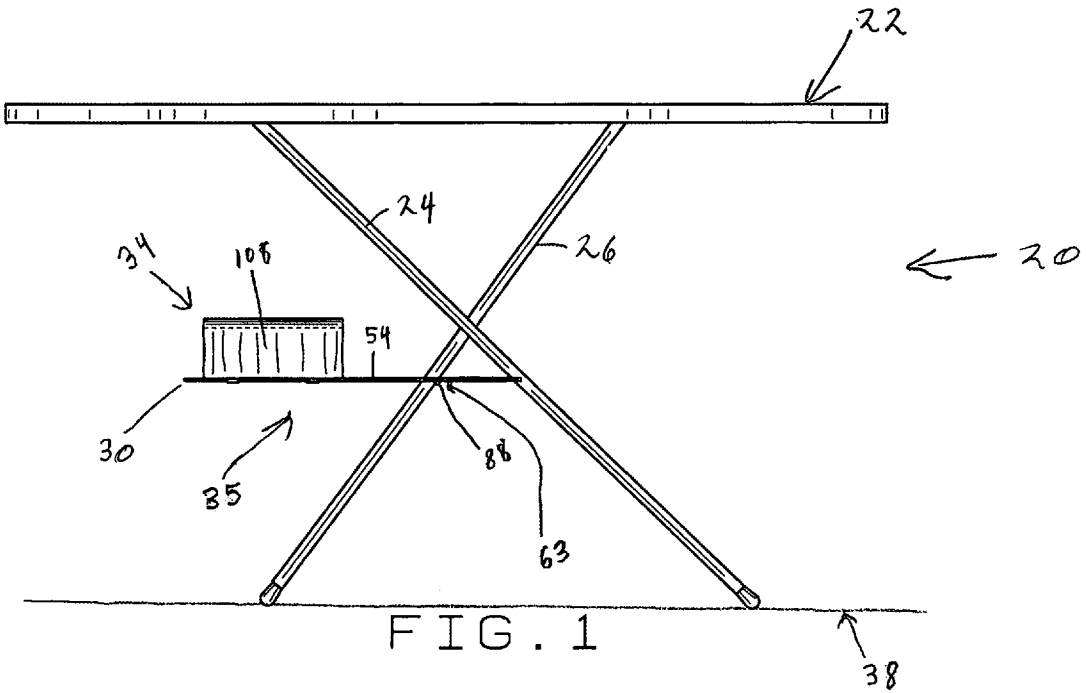
FIG. 1 shows the ironing table collapsible container and container support ensemble of the invention in an extended position, with the container shown in an extended position and the ironing board positioned for use.
Figure 2:
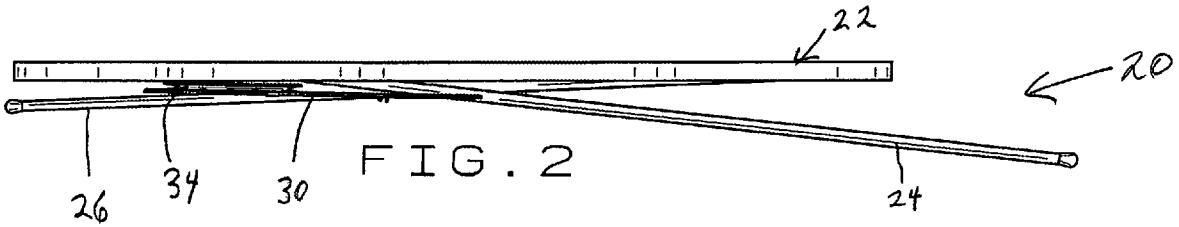
FIG. 2 illustrates the ensemble with the container in a collapsed position while still being mounted to the container support, and with container support as well as the legs and ironing board being moved to a folded position relative to the legs and ironing board.
Figure 3:
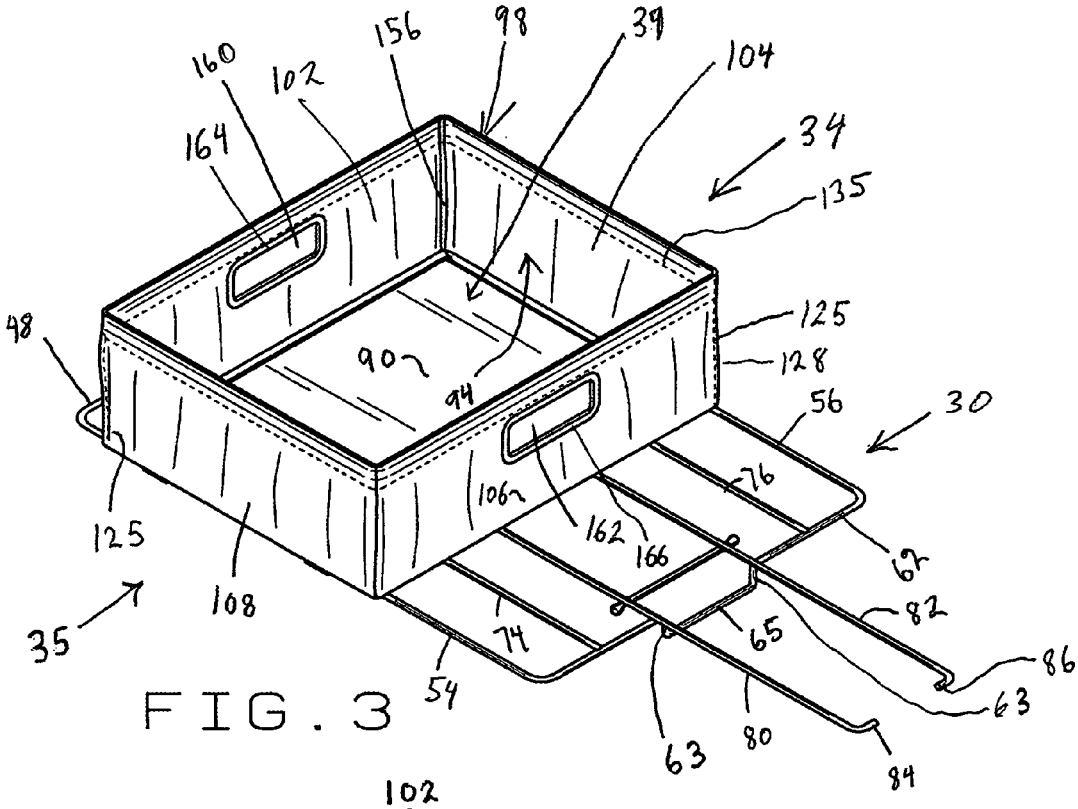
FIG. 3 is an isometric view of the container mounted to the container support with the container in an extended position, with a cross brace mounted to a leg stand shown isolated from the leg stand.
Figure 4:
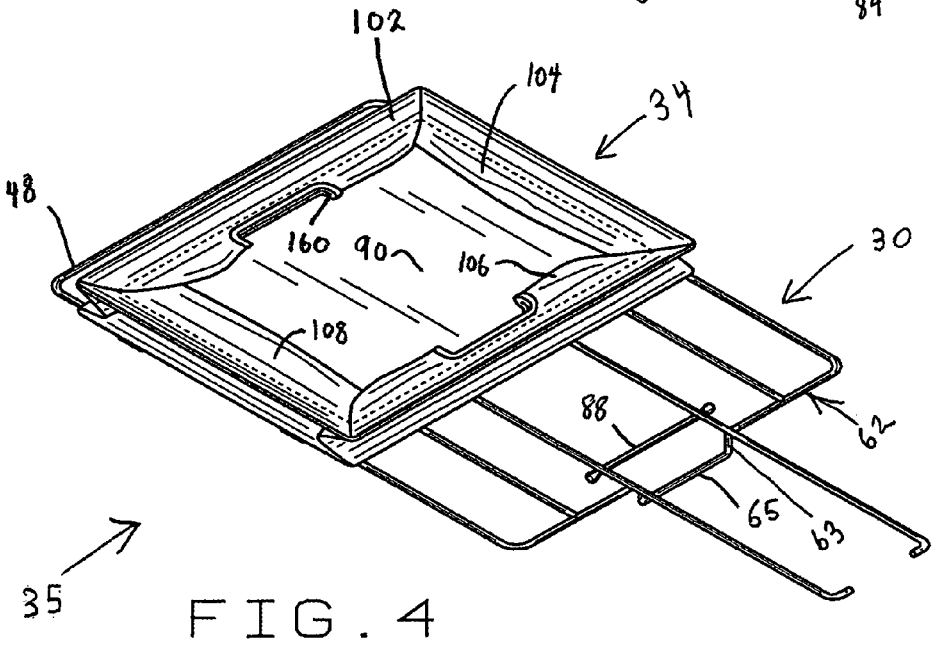
FIG. 4 is an isometric view showing the container in a collapsed position while being mounted to the shelf, with a cross brace mounted to a leg stand shown isolated from the leg stand.
Figure 5:
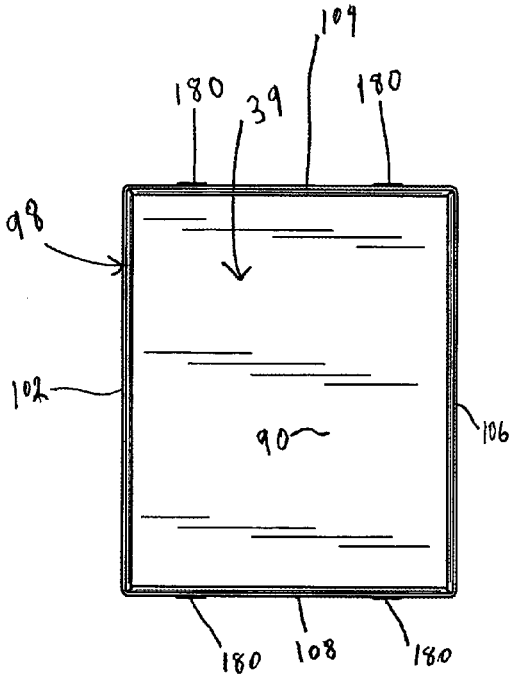
FIG. 5 is a top plan view of the container in the extended position, with the fastening strips hanging downwardly.

Referring to the drawings, the ironing table and container and container support ensemble of the invention is generally depicted as 20. In general, the ensemble 20 comprises an ironing board 22, which is supported in an extended working position as seen in FIG. 1, by a pair of leg stands 24 and 26, which are pivotally joined as by a pin or bolt arrangement as known in the art. The ensemble 20 further comprises a support 30 movably mounted relative to the leg stands 24 and 26, to support a container 34. The support 30 is depicted as a shelf in this preferred embodiment Together the container 34 and support 30 make up a container/support assembly 35. The container 34 preferably is detachably mounted to the support 30 by a fastening assembly 37. With the support 30 in the operable position of FIG. 1, the support 30 is generally parallel to the floorboard 38 and to the board 22, and located beneath board 22. Preferably the container 24 can be set in an extended first position, such as shown in FIGS. 1 and 3, wherein the volume of its compartment chamber 39 is in a first larger expanded condition. Container 24 can also be placed in a compact collapsible second folded position in which it occupies less space, such as illustrated in FIGS. 2 and 4. In such position the support 30 is also folded. In this folded position the ensemble 20 can be moved or stored.

Figure 12:
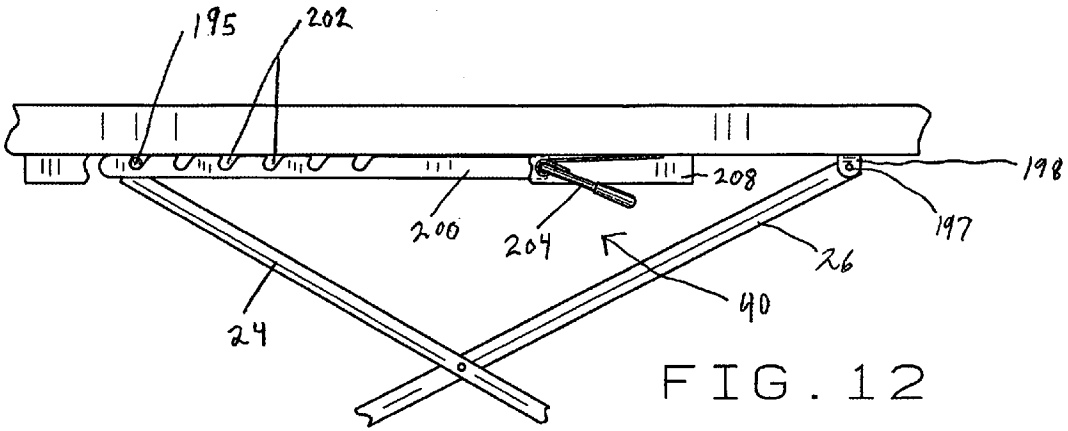
FIG. 12 is a side plan view of the locking sub-assembly, showing the ironing board and legs in a locked position.
Figure 13:
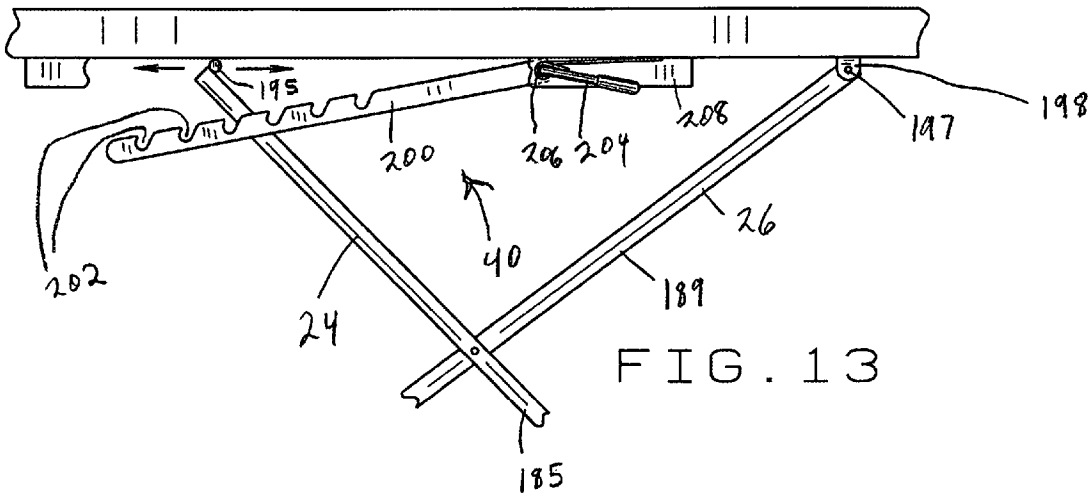
FIG. 13 is a side plan view of the locking sub-assembly in an unlocked position.

The ensemble 20 further includes a locking sub-assembly 40, such as depicted in FIGS. 12 and 13. Sub-assembly 40 can be locked in a first position, such as shown in FIG. 12, to lock the board 22 in an operable position as depicted in FIG. 1. Sub-assembly 40 can be disengaged from locking connection as illustrated in FIG. 13, so that the legs and ironing board can be moved to a collapsed position such as shown in FIG. 2.

More Specific Discussion of Preferred Embodiment

Now attention is more specifically directed to the container/support assembly 34. Turning first to the support 30 that is depicted as a shelf, the support 30 comprises a perimeter bar 46, which has a generally rectangular configuration. Bar 46 comprises a distal rod section 48, which at both of its ends has elbows 50 and 52 that extend into side rods 54 and 56, respectively. Side rods 54 and 56 extend respectively into elbows 58 and 60, which bend into a proximal rod section 62. Rod section 62 has outer rod parts 61 that bend at right angles into a pair of bars 63. Bars 63 then bend at right angles into a centrally located midbar 65. Together the bars 63 and midbar 65 form a U-shaped section which receives leg tubes of the leg stands 24 and 26 when the ensemble 20 is folded.

The support 30 further comprises a pair of internal struts 74 and 76, which are joined at their ends as by welding to the perimeter rod sections 48 and 62. Support 30 further comprises longitudinal strut bars 80 and 82, which have their distal ends secured as by welding to the distal rod section 48. The proximal ends of struts 80 and 82 bend inwardly at right angles into proximal connecting fingers 84 and 86, which are aligned with each other. The fingers 84 and 86 fit within conforming bores in leg 24 to pivot relative to leg 24, so that the entire support 30 pivots relative to leg 24. The struts 80 and 82 are also joined to the proximal cross bar 62, as by welding, at each of the bends of rod parts 61 into the bars 63. All of the described parts of the support 30 are preferably of metal, such as of stainless steel. The support 30 is preferably generally flat. Support 30 is shown preferably with a generally rectangular overall configuration although it can have other shapes such as circular, elliptical, oblong, and square.

The leg stand 26 has a cross brace rod 88 secured thereto as by welding. The support 30 can rest upon brace 88 as seen in FIG. 1. The cross brace rod 88 is shown isolated from leg stand 26 in FIGS. 3, 4 and 9 so that it can be seen that the longitudinal strut bars 80 and 82 rest upon it to hold support 30 in the working position of FIG. 1.

Now focusing on the container 34 of assembly 44, the container 34 generally has a floor 90, which can be of a single rectangular shaped piece of fabric. Extending upwardly from floor 90 is collapsible wall structure 94. Wall structure 94 has an upper edge 98. In the extended position of FIGS. 1 and 3, the container 34 defines the container chamber 39 having a volume V within the boundaries of the floor 90 and the wall structure 94.

Figure 10:
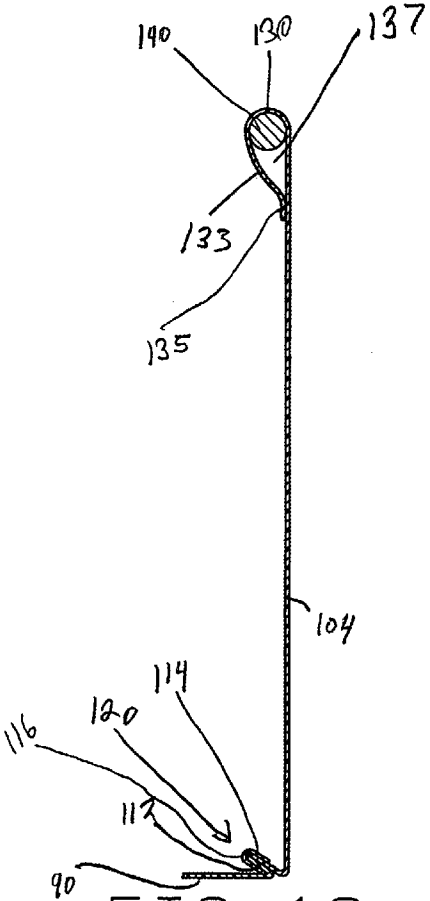
FIG. 10 is a section view taken on the line 10–10 of FIG. 7, showing the frame rod extending through the passageway about the top edge of the container, and showing binding about the inwardly extending lower edges of a sidewall and an outer edge floor of the container.

More specifically, the floor 90 is depicted to be of generally rectangular shape. The edges of the rectangular floor extend upwardly to join the lower edges of four sidewalls 102, 104, 106 and 108. FIG. 10 depicts a specific illustration of an upturned edge 112 of floor 90 extending adjacent the lower inturned edge 114 of sidewall 104. Binding 116 has a generally U-shaped cross section as depicted in FIG. 10, and fits around the four floor edges 112 and the lower edges 114 of the side walls 102, 104, 106 and 108, with the binding 116 secured thereto as by stitching to create a hemmed flange 120. Flange 120 extends along the perimeter of the floor 90. The flange 120 helps to provide rigidity for the lower part of the container 34, especially when the container 34 is in the extended position of FIGS. 1 and 3.

The sidewalls 102, 104, 106 and 108 are preferably formed from a single unitary piece of fabric, which in the preferred embodiment has a rectangular layout that can be folded to form the sidewalls 102, 104, 106 and 108. Stitching 125 through the ends of adjacent sidewalls, including the inturned loops 130 and flaps 133, provide seams 128. Hence there are four such seams 128 along each of the four corner edges of the container 34.

As depicted in FIG. 10, the upper edges of each of the sidewalls 102, 104, 106 and 108 extend upwardly, then loop inwardly at 130, and thence extend downwardly into a section 133. Stitching 135 near the bottom of section 133 joins section 133 to the corresponding sidewall, such as sidewall 104 in FIG. 10. This structure thus provides a passageway 137 between the loop 133 and section 133 and the corresponding top of the sidewalls 102, 104, 106 and 108. A unitary frame rod 140 extends through passageway 137.

Figure 11:
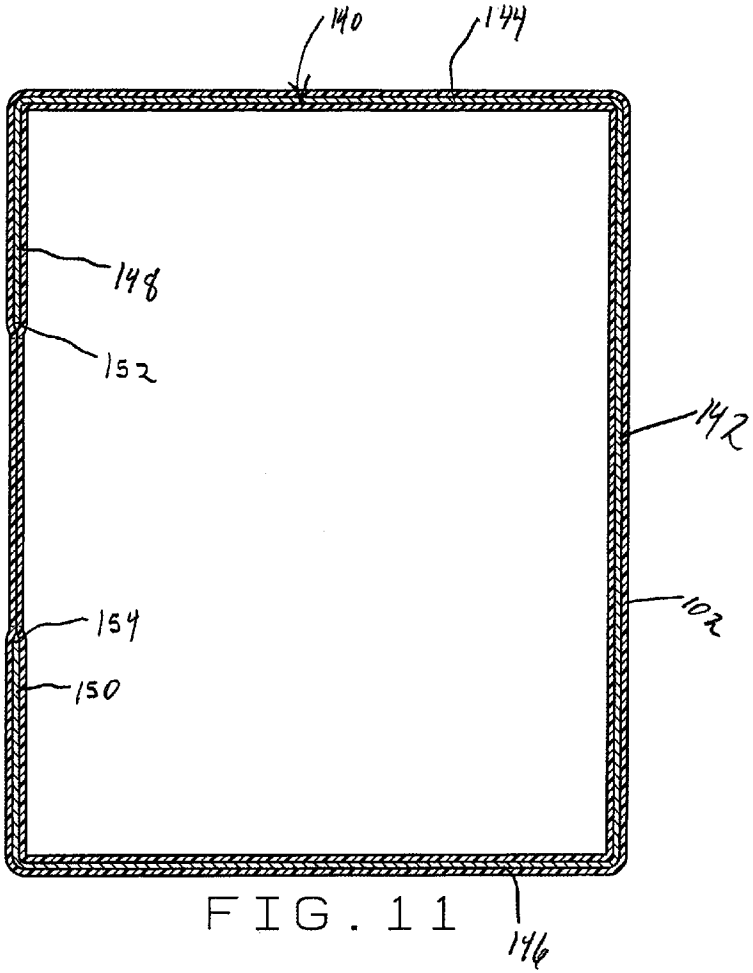
FIG. 11 is a section taken on the line 11–11 of FIG. 7, showing the upper frame rod extending through the passageway about the top of the container.

As seen in FIG. 11, frame 140 is generally of a C-shape, having a longer section 142. Section 142 bends at its ends to extend unitarily into legs 144 and 146. Legs 144 and 146 in turn bend at their ends to extend unitarily into feet 148 and 150 having ends 152 and 154, respectively. Rod 140 is preferably made of a metal such as stain less steel, or could be of other rigid material such as plastic.

The unitary piece of fabric forming the side walls 102, 104, 106 and 108 has its ends turned inwardly at the junction of walls 102 and 104 and secured together with binding 156 of the same material as the binding 120, to provide rigidity and connection of the sidewalls 102 and 104.

Oblong openings 160 and 162 are formed in the walls 102 and 106, respectively. Binding 164 and 166 is sewn about the edges of openings 160 and 162 to form gripping handles. The frame rod ends 152 and 154 preferably extend through the passageway 137 to points above but slightly to the outside of opening 160.

Figure 7:
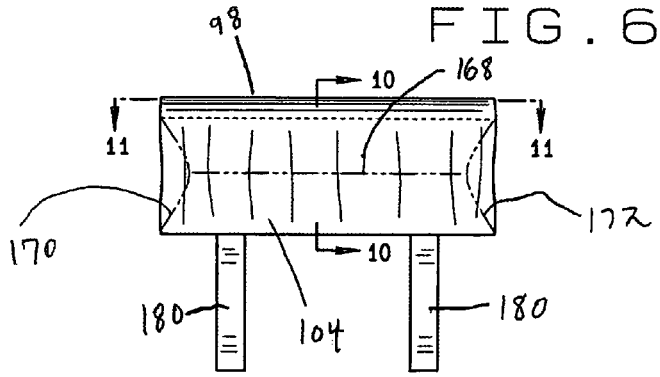
FIG. 7 is a side plan view of the container with the fastening straps shown extending downwardly generally perpendicular to the container floor as they are in FIG. 5.
Figure 8:
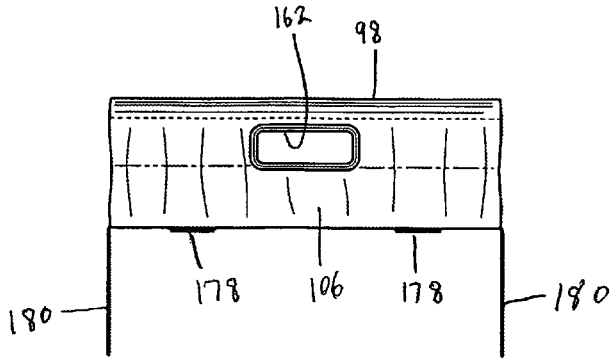
FIG. 8 is a side plan view of the container taken from another view of the container while in the position of the FIG. 7, showing a handle in a container side.

Crease lines 168, 170 and 172 can be preformed in the sidewalls, such as depicted for sidewall 104 in FIG. 7, to facilitate collapsing of the container 34 to a position such as seen in FIG. 4. The configuration of container 34 can be other than the rectangular prism shape that is generally shown, such as cylindrical, octagonal, hexagonal, elliptical, oblong and other suitable shapes.

Figure 6:
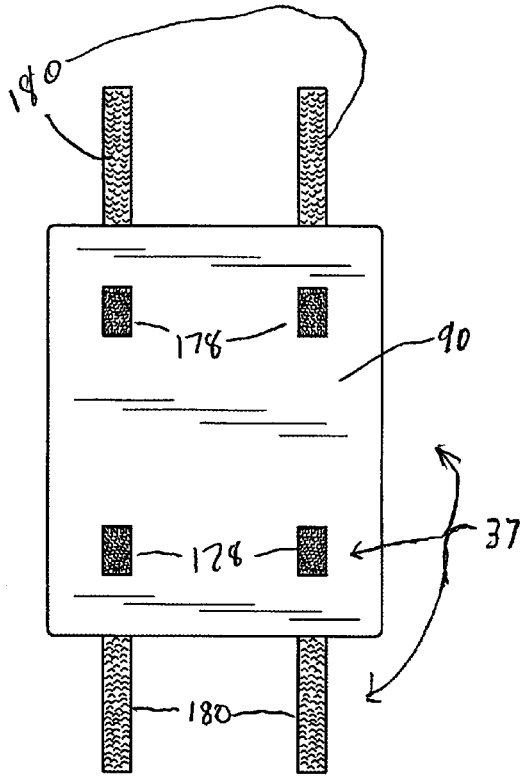
FIG. 6 is a bottom plan view of the container in the extended position, showing the straps and catch arrangement of hook and loop fasteners, with the straps stretching outwardly away from the container generally aligned with the floor of the container.
Figure 9:
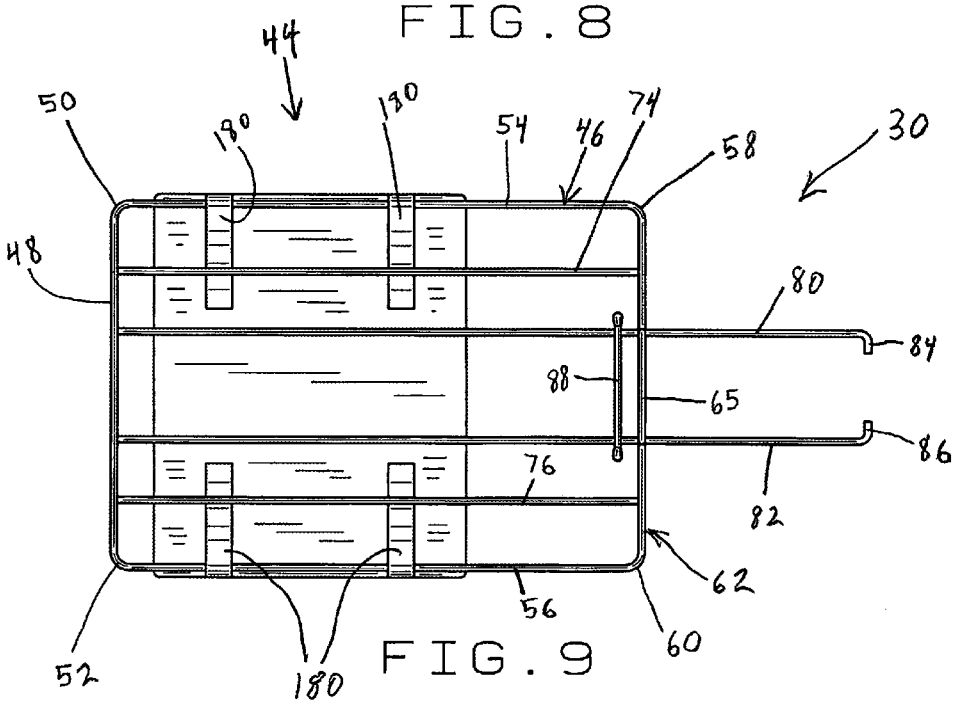
FIG. 9 is a bottom plan view of the container mounted to the container support, with the straps shown extended around the perimeter bar of the container support to be secured to the catches on the underside of the container, with a cross brace mounted to a leg stand shown isolated from the leg stand.

The fastener subassembly 37 is provided to detachably secure the container 34 to the support 30. The subassembly 37 preferably comprises hook and loop fabric fastening members such as sold under the trademark VELCRO. Fastener strips of material 178 are secured as by stitching to the underside of floor 90 as illustrated in FIG. 6. Subassembly 37 further comprises straps 180 of hook material, whose proximal ends fit within the binding 114 between the floor edge 112 and the inturned side walls edges 114, to be secured thereto as by stitching. The length of the straps 180 are such that when the underside of the floor 90 is placed on the support 30, as seen in FIG. 9, the straps 180 can extend about the underside of side rods 54 and 56, and thence pass along the top side 3 of side strut 74 and 76. Then straps 180 are secured to the latching strips 178 to thus hold container 34 to support 30 when both in the operating position of FIGS. 1 and 3, and the folded storage or transportation configuration of FIGS. 2 and 4.

The container side walls 102, 104, 106 and 108, as well as floor 90, are preferably made of polyester, coated with polyvinylchloride (PVC) to provide increased rigidity. In the embodiment illustrated the length of the container front to rear is about twelve inches, the width about fourteen and one half inches, and the height about five inches. The container size will vary depending on the size of the support and of the ironing board, and the amount or size of items to be placed in the container 34. The straps 180 are about five inches long and one inch wide.

Figure 14:
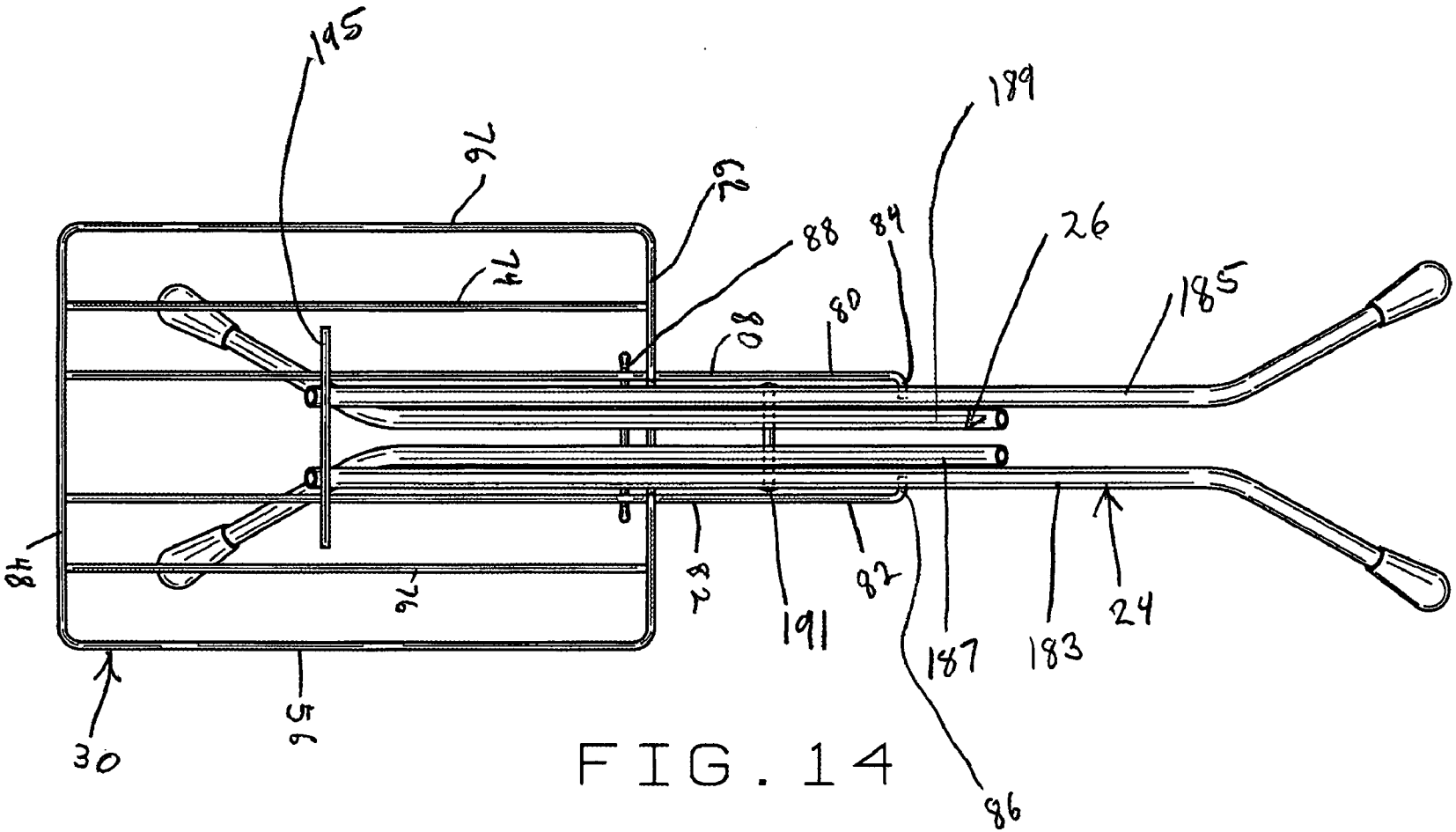
FIG. 14 is a bottom plan view of the ironing board and container support without the container, with the ironing table and container support in the extended position such as illustrated in FIG. 1.

Referring now to FIG. 14, it can be seen that, as well known in the art, the leg stand 24 can preferably comprise a pair of leg tubes 183 and 185, while the leg stand 26 preferably comprises a pair of leg tubes 187 and 189. The bottoms of leg tubes 183 and 185 can bend outwardly as known in the art and be connected rigidly by cross braces (not shown) as known in the art. Likewise, leg tubes 187 and 189 bend outwardly toward their bottoms and can be connected by a cross brace (not shown). A pivot pin 191 can extend through holes in the tubes 183, 185, 187 and 189 to pivotally connect them, as known in the art. At their top ends the leg tubes 183 and 185 are rigidly connected as by welding to a lock bar 195. The upper end of leg tubes 187 and 189 are secured as by welding to a pivot pin 197 mounted to a bracket 198 connected to the board 22, as seen in FIGS. 12 and 13 (not shown in FIG. 14).

It can be seen in FIG. 14 that the connecting fingers 84 and 86 of the longitudinal strut bars 80 and 82 fit into conforming holes in the leg tubes 185 and 183, respectively, so that the fingers 82 and 84, and the support 30, can pivot relative thereto.

The locking subassembly 40 is of a type well known in the art, which comprises the aforementioned lock pin 195, and a pair of lock plates 200 having a plurality of lock notches 202. Notches 202 are shaped to receive and lockingly engaged the lock pin 195. Subassembly 40 also includes a rotatable handle 204 that bends unitarily into a transverse bar (not shown), which bar rotatably extends through track members 208 secured to the bottom side of the board 22, with the bar being secured as by welding to the ends of the lock plates 200.

Handle 204 and its bar can be rotated to move the lock plates 200 to disengage from lock pin 195 as seen in FIG. 13, and to engage the lock pin 195 in a selected notch 200 for various locked positions, one of them being shown in FIG. 12. A torsion spring 206 mounted to the handle 204 and to its bar, and to the track member 208, biases the handle 204 and plates 200 to a locked position as in FIG. 12.

Other sorts of assemblies known in the art can be used to lock the ironing board ensemble 20 in position. Such assemblies can, for example, and not by way of limitation, be such as shown in U.S. Pat. No. 4,769,894, issued Sep. 13, 1988, and U.S. Pat. No. 5,335,432, issued Aug. 9, 1994, both with inventor Danny Simpson, which patents are incorporated by reference herein. Although the ensemble 20 and its locking sub-assembly 40 have been illustrated with leg stands 24 and 26, which stands each comprise a pair of leg tubes, the invention can also be used with locking sub-assemblies and leg stands having single tube legs, such as illustrated in U.S. Pat. No. 2,974,431, issued Mar. 14, 1961, with named inventor Tony Ribaudo; U.S. Pat. No. 2,913,839, issued Nov. 24, 1959, with named inventor Ernest V. A. Ashby; U.S. Pat. No. 3,152,561, issued Oct. 13, 1964, with named inventor D. J. Munson, et al.; and U.S. Pat. No. 2,748,512, issued Jun. 5, 1956, with named inventor Frederick W. Kulicke, Jr., which patents are incorporated by reference herein.

Thus it can be seen that the top edge 98 of the container 34 is formed along the top of loop section 130 as exemplified in FIG. 10. The volume V of the container chamber 39 in the extended position of FIGS. 1, 3, 7 and 8, is thus defined as the volume within the confines of the floor 90, the extended sidewalls 102, 104, 106 and 108. The volume V is thus enclosed by an imaginary ceiling extending across the top edge of the sidewalls 102, 104, 106 and 108, or said another way, a ceiling across the top edge 98 of the wall structure 94.

In operation, from the extended position of FIGS. 1 and 3, the container 34 can be moved to a collapsed position by the operator's hand pressing downwardly upon the wall structure 94. Preferably such force is applied to the wall structure 94 located above the frame rod 140. Force supplied at one point along the wall structure above frame 140, such as along the upper edge of wall 102, will be transferred to the rod section 142, as well as to the frame sections 144 and 146, and sections 148 and 150, to help lower the entire wall structure edge 98. The container 34 can thus be moved to the collapsed position of FIGS. 2 and 4.

The locking sub-assembly 40 can thence be moved from the locked position of FIG. 12 to the unlocked position of FIG. 13. Next the leg stands 24 and 26 can be pivoted toward a folded position, and with such pivoting the container support 30 pivots about its fingers 84 and 86 relative to leg stand 24 to move closer to board 22 so that support 30 folds towards board 22 as the leg stands 24 and 26 move toward the board 22 until the folded position of FIG. 2 is achieved.

In the folded position, as seen in FIG. 14, the leg tubes 183, 185, 187 and 189 lie within the U-shape formed by support bars 63 and mid bar 65. In such position the longitudinal struts 80 and 82 extend adjacent to and along side the exterior of the leg tubes 183 and 185.

Thus during this folding of the ensemble 20, the latching subassembly 37 keeps the container 34 attached to the support 30. In the FIG. 2 position, with the container 34 in the collapsed foldable position, the container 34 takes up a much smaller amount of space than in the extended position of FIGS. 1 and 3. In the FIG. 2 folded position, the ensemble 20 can be stored, or moved to another location where it can be unfolded toward the working position of FIG. 1. To do so, the leg stands 24 and 26 are moved away from the board 22 in the well known manner. As this happens, the pivot fingers 84 and 86 of support 30 pivot openly relative to the leg stand 24 so that support 30 pivots away from the leg stand 24 as the leg stands spread outwardly from each other. This occurs until a desired working position such as of FIG. 1, is reached. The handle 204 can be operated and lock pin 195 moved in a selected lock plate notch 202 to hold board 22 at a desired height. In this working position the cross brace 88 affixed to leg stand 26 engages the support struts 80 and 82 at the position such as illustrated in FIGS. 1, 4 and 9, to hold the support 30 generally parallel to the board 22 and to floor board 38. The operator's hands thence can grasp the container 34 along the container upper edge 98 at a point just beneath the frame 140, to pull the upper edge 98 upwardly away from the floor 90 to the expanded position of FIGS. 1 and 3. In this working position the container chamber 36 can receive various articles such as containers of laundry substances, such as spray bottles, containers of starch, and other such articles, as well as sprinkled clothes to be ironed. Thus, the container 30 can remain attached with the ensemble 20 in both the working position and collapsed storage/transportation position to the great convenience and satisfaction of the operator. The ensemble 20 can be packaged and shipped with the container/support assembly 35 in the folded position of FIG. 2. When a consumer unpacks the ensemble 20 from its box or packaging, ensemble 20 can be readily moved to the working position of FIG. 1, or stored, if desired.

The fastening assembly 37 can be disengaged from the support 30, and the container 34 taken to a location away from the support 30 and leg stands 24 and 26, and placed on a table or shelf to hold various items.

Figure 15:
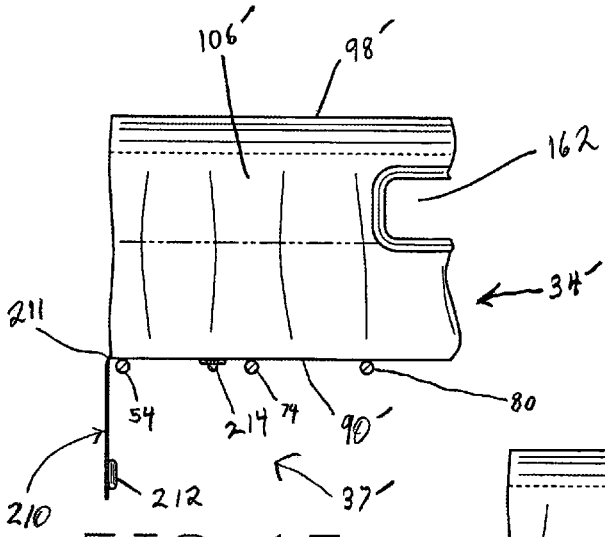
FIG. 15 is a partial side plan view of a modification of the container showing a modified strap with snap members.

Turning now to modifications of the strap assembly, with reference to FIG. 15, the fastening assembly 37' can alternatively comprise straps 210 whose proximal ends 211 can be secured to the container floor 90' such as described for straps 180. Toward the distal ends of straps 210 are secured snap members 212 with receptive openings shaped to match and latch with male configured snap members 214 that are secured to the underside of floor 90'. The snap members 212 and 214 can be of metal or plastic. The straps 210 extend about, and are engaged with, the support 30 in the same fashion as described for straps 180.

Figure 16:
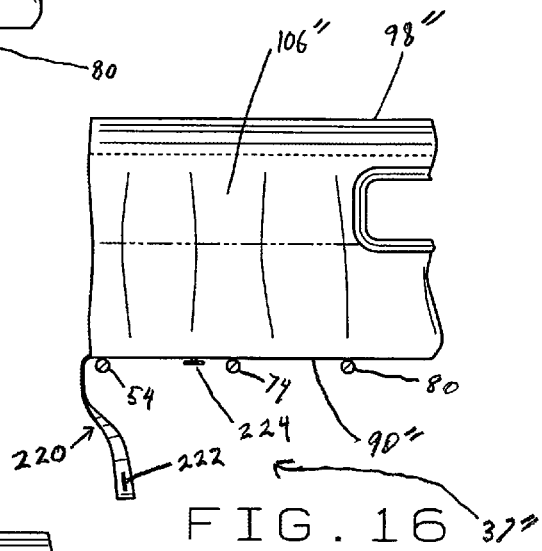
FIG. 16 is a partial side plan view of another modified container showing a modified strap and button securing arrangement.

FIG. 16 shows as another alternate embodiment the strap assembly 37" which features an exemplary strap 220, which has its proximal end secured to the floor 90" as described for straps 180. Toward the distal end of strap 220 the strap has a longitudinal slit 222 extending therethrough. A button 224 is secured to the underside of floor 90" as by threads. The straps 220 can extend about the support 30 as described for straps 180, and button 224 can be passed through the slit 222 to engage the distal end of strap 220 to the container 34" to hold it to the support 30.

Figure 17:
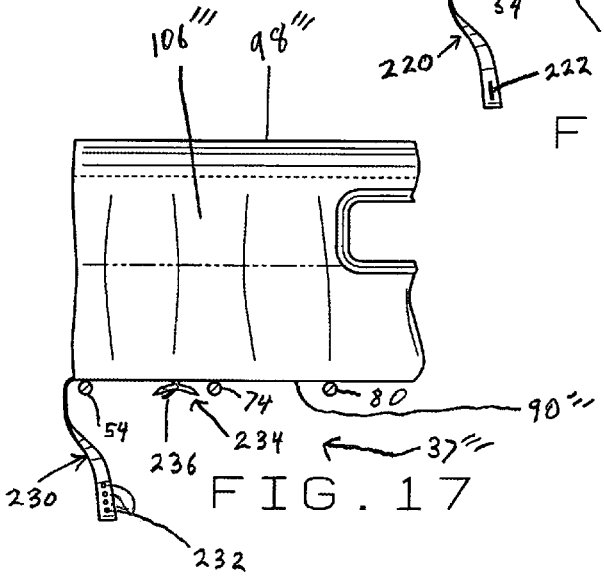
FIG. 17 is a partial side plan view of yet another modified container illustrating a strap with holes to latch with a buckle and tine.

In the modification of FIG. 17 the straps 230 have their proximal ends secured to the container floor 90''' such as earlier described for straps 180. The distal end of strap 230 has a plurality of aligned holes 232 extending therethrough sized to receive a buckle tine to be described. A buckle 234 having a tine 236, such as made of metal or plastic, is secured to the underside of floor 90'''. The strap 230 extends about support 90 as heretofore described and can pass through the buckle 234 so that the buckle tine 236 can extend through a selected strap hole 232 to secure the straps 230 to the buckles 234, and thereby secure the container 34''' to support 90.

In the embodiments of FIGS. 1–17, four straps are illustrated positioned such as exemplified. However as few as one strap and latch assembly can be provided, and such a single strap can be of a length to extend from a container wherein the proximal strap end is near perimeter side rod 54, with the strap passing along the underside of the struts 74, 80, 82 and 76, to be secured to latch with the underside of floor 90 near the opposite perimeter side bar 56. Such strap could also even pass along the underside of side bar 56 to be secured to a latch member mounted to the outside of container side wall 104. The positioning of the four straps and latch assemblies as shown in the preferred embodiment provides balance and an even distribution of engaging force of the container relative to the support.

Figure 18:
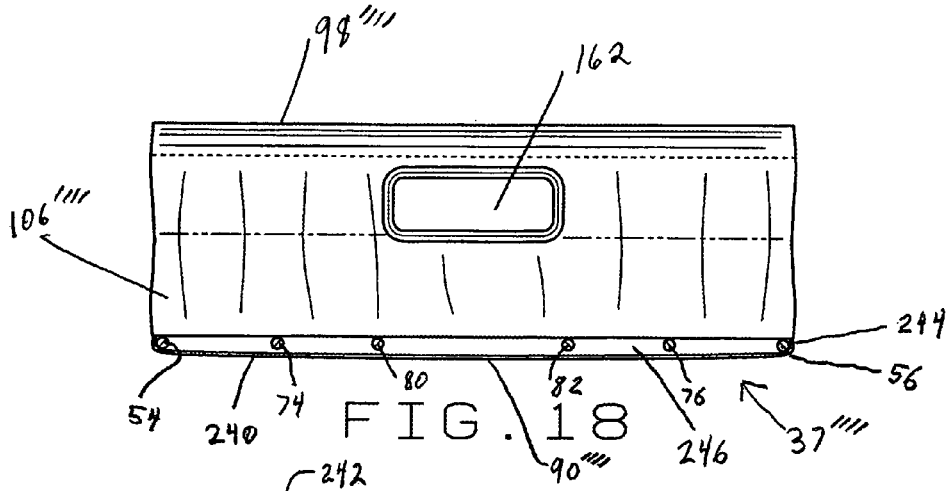
FIG. 18 is a side plan view of a further modified container featuring a strap or band that extends about the support.
Figure 19:
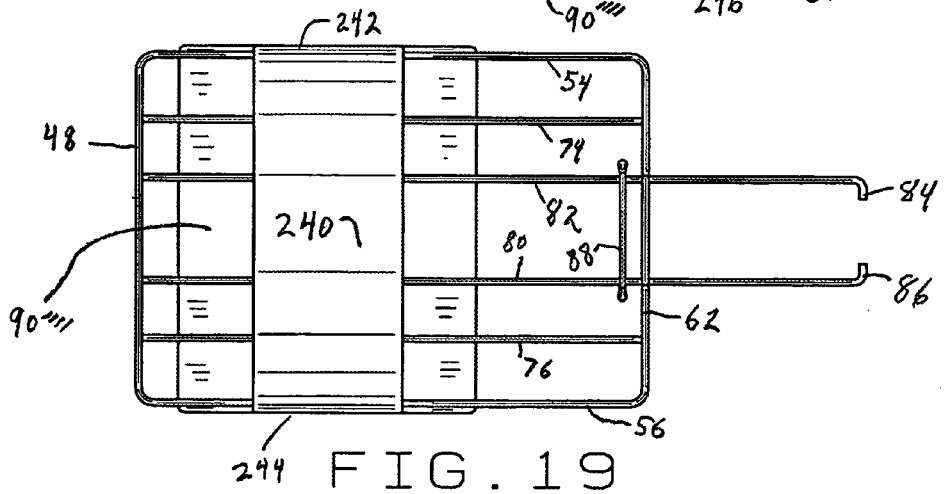
FIG. 19 is a bottom plan view of the modified container of FIG. 18 mounted with the support.
Figure 20:
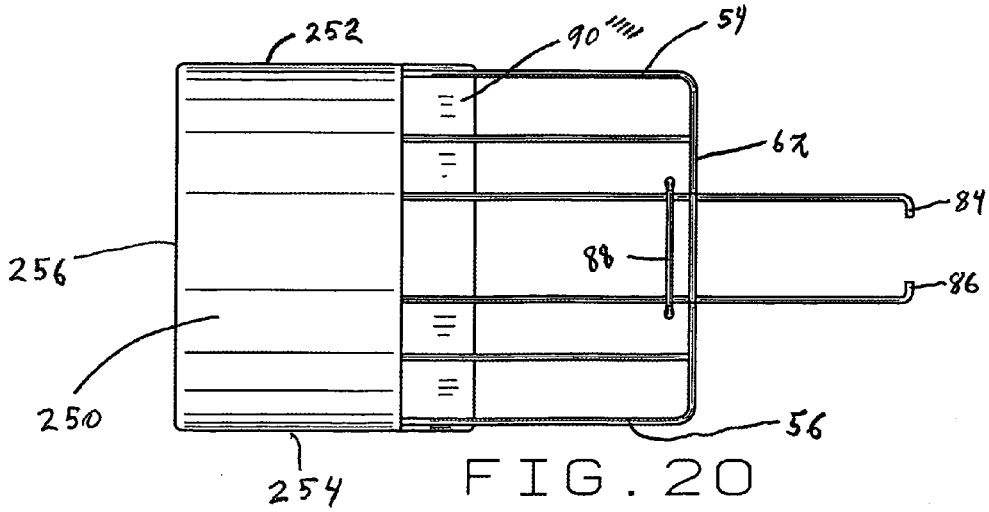
FIG. 20 is a bottom plan view of an additional modified container having a pocket on the underside thereof, which pocket receives the support.

Further modifications are shown in FIGS. 18–20. In FIGS. 18 and 19 is shown a strap or band 240 which is relatively wider that the straps 180. In the example shown, the strap 240 has two side ends 242 and 244 which can be secured to the floor 90'''' as describe for securing the proximal ends of straps 180. The side ends 242 and 244 are generally aligned with the sides of floor 90'''' along which they extend. A passageway 246 is formed between the top surface of strap 240 and the bottom of floor 90''''. The container 34'''' can be positioned with the hands in front of support 30, with the passageway 246 aligned with the support 30. The container 37'''' can then be moved rearwardly so that the support 30 extends through passageway 246 as seen in FIGS. 18 and 19, to a desired position. In such position, the sideways, upper and lower movement of the container 37'''' relative to the support 30 is resisted by the strap 240 and container floor 90''''. Yet the container can be easily removed from the support 30 by sliding the container 37'''' forwardly until the support 30 is no longer located within passageway 246. As shown in FIGS. 18–19, the strap 240 is preferably located so that its front and rear edges are approximately equidistant from the front and rear container floor edges, respectively. With the preferred embodiment floor depth of about twelve inches, the width of band 240 can be about six inches. Although a single strap or band has been illustrated as preferable, two or more bands or straps could be used and preferably be placed equidistantly from each other and the front and rear ends of the container floor 90.

FIG. 20 illustrates an alternate embodiment that has a strap or band 250 with its side ends 252 and 254 secured to the floor 90''''' such as described for strap ends 242 and 244 in the embodiment of FIGS. 18–19. However the strap 250 also has its front end 256 secured to floor 90''''' in the same fashion as ends 242 and 244, so that a pocket is formed between floor 90'''' and strap 250. The pocket so formed has a passageway shaped and sized as passageway 246 to allow support 30 to slide therein. In mounting the container 34''''' on support, the alignment of support 90 and movement is as described for the FIGS. 18–19 embodiment, except that as the support 90 slides within the pocket, the support's front rod section 48 abuts the closed pocket end 256 to resist further rearward movement of the container relative to support 30. The strap 250 is preferably wider than the single strap 240, as strap 250 is not centrally positioned relative to the container floor as is strap 240. With the preferred embodied floor depth of twelve inches, the preferred width of band 250 is about nine inches.

Another embodiment that is less preferable, is to have straps such as 210 made of elastic material with hooks secured to the distal ends where the snaps 212 are located, which hooks fit about the struts 74 and 76, or about struts 80 and 82, to hold the container to the support 90.

In view of the above, it will be seen that inventive advantages have been achieved. As various changes could be made in the above constructions without departing from the scope of the invention, it is intended that all matter contained in the above description or shown in the accompanying drawings shall be interpreted as illustrative and not in a limiting sense.

What is claimed is:

1. An ironing table and container support ensemble, wherein the container can contain laundry related items, comprising:

(a) an ironing board movably mounted to leg stands so that the leg stands can support the board in a first working position for ironing items on the board, and so that the leg stands can be folded with the board to a second folded position;

(b) a support for the container, the support being movably mounted relative to the leg stands and to the board so that the support can occupy a first position beneath the board when the board is in the first working position, and wherein the support can be moved to a second folded position relative to the board and leg stands when the board and leg stands are in the second folded position, with the support closer to the board when the board and leg stands are in the second position; and (c) a container secured to the support, the container having wall structure to be capable of being placed in a first extended position so that a chamber for containing items is formed by the container, and so that the container is capable of being placed in a second position with the container structure occupying less space than occupied in the first container position; the container having a shape and size so that an underside of the container can rest upon the support when the support and board are in their first positions so that items can be placed within the container.

2. The ironing table and container support ensemble of claim 1, wherein the ensemble comprises a first leg stand and a second leg stand, and wherein the support is pivotally connected to the first leg stand, and wherein the leg stands are pivotally connected to each other, with the support being generally flat so that in the first support position the support extends generally parallel to the board, and wherein the second leg stand has structure upon which the support rests in the first support position to hold the support in said generally parallel position.

3. The ironing table and container support ensemble of claim 1, wherein the container is detachably secured to the support so that it can be disengaged from the support and reengaged to the support.

4. The ironing table and container support ensemble of claim 3, wherein the support comprises longitudinal struts, said struts having pivot fingers located on each of the struts which pivot fingers are mounted to a leg stand to pivot relative to that leg stand.

5. The ironing table and container support ensemble of claim 4, wherein the pivot fingers of the longitudinal struts are pivotally mounted to the first leg stand, and wherein the structure on the second leg stand that holds the support in generally parallel position, is a cross brace which engages the underside of the longitudinal struts.

6. The ironing table and container support ensemble of claim 3, wherein the container has a generally rectangular configuration, and comprises a generally rectangular floor and generally rectangular walls extending upwardly therefrom.

7. The ironing table and container support ensemble of claim 3, wherein the container wall structure is formed of unitary piece of fabric, which fabric folds into a plurality of wall panels, the bottoms of the wall panels being joined to the edges of the floor, with the bottom ends of the wall panels turned inwardly, and the bottom edges of the floors being turned inwardly, with the bottom inturned edges of the wall panels and the inturned edges of the floors being secured to each other by binding to provide rigidity for the bottom of the container.

8. The ironing board table and container support ensemble of claim 7, wherein the fabric forming the unitary wall structure has edges, which are joined at a corner of the container with the edges of the fabric turned inwardly and secured together with binding to provide rigidity at a corner of the container.

9. The ironing table and container support ensemble of claim 8, wherein the binding is secured to the edges of the wall structure by stitching.

10. The ironing table and container support ensemble of claim 7, wherein the bottom edges of the wall panels and the inturned edges of the floor are secured to each other and to the binding by stitching.

11. The ironing table and container support ensemble of claim 3, wherein the container support further comprises a perimeter bar which extends about the outer boundaries of the support, and internal struts which have their ends secured to the perimeter bar.

12. The ironing table and container support ensemble of claim 3, wherein the container is detachably mounted to the support by at least one strap, the strap having a first part having a first connection to the container at a first container location, the strap having a second part capable of being detachably connected to the container at a second container location, the strap being extendable about part of the support so that the detachable strap part can be fastened to the container at the second container location to engage the container to the support, and the detachable part of the strap can be detached from the container at the second container location to allow the strap to be moved away from the support so that the container can be disengaged from the support.

13. The ironing table and container support ensemble of claim 12, wherein the second detachable part of the strap has a fastener secured thereto, and wherein the container has a latch located at the second container location, which latch matches with the fastener so that the strap fastener can be secured to the latch to hold the container to the support, and the fastener can be unlatched from the latch to allow the strap to be disengaged from the support.

14. The ironing table and container support ensemble of claim 13, wherein the strap fastener and the latching member on the container comprise loop and hook fastening material.

15. The ironing table and container support ensemble of claim 13, wherein the fastener is a first snap member affixed to the strap, and the latch is a corresponding second snap member secured to the container and shaped to latch with the first snap member, wherein the snap members can latch together to hold the fastener strap to the container and hold the container to the support, and the snap members can unfasten from each other.

16. The ironing table and container support ensemble of claim 15, wherein one of the strap or the container comprises a button secured to the strap or container, and the other of the strap or container has an opening corresponding to the size of the button to allow the button to be inserted therethrough to latch the second strap part to the second container location, and to allow the strap to be unfastened from the button so that the strap can be disengaged from the button and disengaged from the support.

17. The ironing table and container support ensemble of claim 3, wherein the container has a strap having a first and a second end, the strap being positioned beneath the floor with the strap ends secured to the container so that a space is formed between the strap and the underside of the container, the opening between the strap and the underside of the container being sized to receive the support therethrough so that when the support is extended through said opening, upward and lateral movement of the container relative to the support is resisted by the strap, and so that the container can be pulled by the hand forwardly to slide the strap and container away from the support to disengage the support from the container.

18. The ironing table and container support ensemble of claim 17, wherein the strap has two ends each end being secured to the container along the side edge of the floor.

19. The ironing table and container support ensemble of claim 17, wherein the strap is secured to the underside of the container to form a pocket, the pocket being sized to receive the support therein, so that when the support is received within the pocket with the support contacting the closed end of the pocket, upward, lateral, and rearward movement of the container relative to the support is resisted by the support, and so that the container can be pulled by the hand forwardly to slide the pocket and container away from the support to disengage the support from the container.

20. The ironing board and container ensemble of claim 19, wherein the strap has a front edge secured along the front of the underside of the floor of the container, and the strap has two ends, each end being secured to the container along the side edge of the floor.

21. The ironing table and container support ensemble of claim 3, further comprising a frame associated with the wall structure to provide rigidity to the wall structure.

22. The ironing table and container support ensemble of claim 21, wherein the container frame comprises a unitary rod extending about the top edge of the wall structure.

23. The ironing table and container support ensemble of claim 21, wherein the container further comprises the wall structure having a pair of handle openings formed within the wall structure on opposite sides of the container.

24. The ironing table and container support ensemble of claim 22, wherein the wall structure has a passageway extending within the wall structure along the top edge of the wall structure, and wherein the unitary rod extends within the wall passageway.

25. An ironing table and container support ensemble, wherein the container can contain laundry related items, comprising:

(a) an ironing board movably mounted to a first leg stand and to a second leg stand, the leg stands being pivotally connected to each other so that the leg stands can support the board in a first working position for ironing items on the board, and so that the leg stands can be folded with the board to a second folded position;

(b) a generally flat support for the container, the support being pivotally connected to the first leg stand so that the support can occupy a first position generally parallel to the board and beneath the board to support the container when the board is in the first working position, the second leg stand being secured to a cross brace which engages the support to maintain the first support position, the support comprising a perimeter bar which extends about the outer boundaries of the support, the support also comprising longitudinal struts held in position relative to the perimeter bar, said struts having pivot fingers located on each of the struts which pivot fingers are pivotally mounted to the first leg stand to pivot relative to the first leg stand and wherein the support can be moved to a second folded position relative to the board and leg stands when the board and leg stands are in the second folded position, with the support closer to the board when the board and leg stands are in the second position; and (c) a container having wall structure to be capable of being placed in a first extended position so that a chamber for containing items is formed by the container, the wall structure having a passageway extending within the wall structure along the top edge of the wall structure, and wherein a unitary rod extends within the wall passageway to provide rigidity to the wall structure; the container having a shape and size so that the container can rest upon the support when the support and board are in their first positions so that items can be placed within the container, the container being capable of being placed in a second position with the container structure occupying less space than occupied in the first container position; the container being detachably mounted to the support so that it can be disengaged from the support and reengaged to the support.

26. The ironing table and container support ensemble of claim 25, wherein the container wall structure is formed of unitary piece of fabric, which fabric folds into a plurality of wall panels, the bottoms of the wall panels being joined to the edges of the floor, with the bottom ends of the wall panels turned inwardly, and the bottom edges of the floors being turned inwardly, with the bottom inturned edges of the wall panels and the inturned edges of the floors being secured to each other by binding to provide rigidity for the bottom of the container; the fabric forming the unitary wall structure has edges, which are joined at a corner of the container with the edges of the fabric turned inwardly and secured together with binding to provide rigidity at a corner of the container.

27. The ironing table and container support ensemble of claim 26, wherein the binding is secured to the edges of the wall structure by stitching; wherein the bottom edges of the wall panels and the inturned edges of the floor are secured to each other and to the binding by stitching; and wherein the container further comprises the wail structure having a pair of handle openings formed within the wall structure on opposite sides of the container.

28. In an ironing table having an ironing board moveably mounted to leg stands, which leg stands are moveably attached to one another, and a support moveably mounted relative to the leg stands to have a generally horizontal position when the ironing board is in a first working position, wherein the support can be moved to a second folded position relative to the board and leg stands when the board and leg stands are in a second folded position, in which second position the support is closer to the board and to the leg stands:

a container assembly for containing laundry related items, comprising a container having wall structure to be capable of being placed in a first extended position so that a chamber for containing items is formed by the container, the container being capable of being placed in a second position with a container structure occupying less space than occupied in the first position, the container having structure to allow it to be detachably mounted to the support so that it can be disengaged from the support and reengaged to the support.

29. In the ironing table and container support of claim 28, wherein the container is detachably mounted to the support by at least one strap, the strap having a first part having a first connection to the container at a first container location, the strap having a second part capable of being detachably connected to the container at a second container location, the strap being extendable about part of the support so that the detachable strap part can be fastened to the container at the second container location to engage the container to the support, and the detachable part of the strap can be detached from the container at the second container location to allow the strap to be moved from the support so that the container can become disengaged from the support.

30. In the ironing table and container support of claim 29, wherein the second detachable part of the strap has a fastener secured thereto, and wherein the container has a latch located at the second container location, which latch matches with the fastener so that the strap fastener can be secured to the latch to hold the container to the support, and the fastener can be unlatched from the latch to allow the strap to be disengaged from the support.

31. The ironing table and container support ensemble of claim 30, wherein the strap fastener and the latching member on the container comprise loop and hook fastening material.

32. The ironing table and container support ensemble of claim 30, wherein the fastener is a first snap member affixed to the strap, and the latch is a corresponding second snap member secured to the container and shaped to latch with the first snap member, wherein the snap members can latch together to hold the fastener strap to the container and hold the container to the support, and the snap members can unfasten from each other.

33. The ironing table and container support ensemble of claim 30, wherein one of the strap or the container comprises a button secured to the strap or container, and the other of the strap or container has an opening corresponding to the size of the button to allow the button to be inserted therethrough to latch the second strap part to the second container location, and to allow the strap to be unfastened from the button so that the strap can be disengaged from the button and disengaged from the support.

34. The ironing table and container support ensemble of claim 29, wherein the container has a strap having a first and a second end, the strap being positioned beneath the floor with the strap ends secured to the container so that a space is formed between the strap and the underside of the container, the opening between the strap and the underside of the container being sized to receive the support therethrough so that when the support is extended through said opening, upward and lateral movement of the container relative to the support is resisted by the strap, and so that the container can be pulled by the hand forwardly to slide the strap and container away from the support to disengage the support from the container.

35. An ironing table and container support ensemble of claim 34, wherein the strap is secured to the underside of the container to form a pocket, the pocket being sized to receive the support therein, so that when the support is received within the pocket with the support contacting the closed end of the pocket, upward, lateral, and rearward movement of the container relative to the support is resisted by the support, and so that the container can be pulled by the hand forwardly to slide the pocket and container away from the support to disengage the support from the container.

36. The ironing board and container ensemble of claim 35, wherein the strap has a front edge secured along the front of the underside of the floor of the container to form the front end of the pocket, and wherein each end of the strap is secured to the container along a side edge of the floor.

37. A method of engaging and disengaging a container for laundry related items to an ironing board support, comprising:

(a) providing an ironing board movably mounted to leg stands so that the leg stands can support the board in a first working position for ironing items on the board, and so that the leg stands can be folded with the board to a second folded position;

(b) providing a support for the container, the support being movably mounted relative to the leg stands and to the board so that the support can occupy a first position beneath the board when the board is in the first working position, and wherein the support can be moved to a second folded position relative to the board and leg stands when the board and leg stands are in the second folded position, with the support closer to the board when the board and leg stands are in the second position; and (c) providing a container having wall structure to be capable of being placed in a first extended position so that a chamber for containing items is formed by the container, and so that the container is capable of being placed in a second position with the container structure occupying less space than occupied in the first container position; the container having a shape and size so that the container can rest upon the support when the support and board are in their first positions so that items can be placed within the container;

providing structure secured to the container for engaging the container to the support to resist movement of the container relative to the support but to allow the container to be disengaged from the support and reengaged to the support;

placing the container on the supporting so that the container is engaged to the support;

placing the container in a position to receive items within the container;

placing the container in a collapsed position while engaged to the support;

moving the ironing board, leg stands and support to a folded position while the container is engaged to the support and the container is in a collapsed position;

moving the ironing board, leg stands and support to the unfolded first working position while the container is engaged to the support; and disengaging the container from the support.

38. The method of engaging and disengaging a container for laundry related items to an ironing board of claim 37, further comprising:

in the step of providing structure to secure the container to the support but to allow disengagement and reengagement to the support, providing a strap having a first part with a first connection to the container at a first container location, the strap having a second part capable of being detachably connected to the container at a second container location;

extending the strap about part of the support and fastening the detachable strap part to the container at the second container location to engage the container to the support;

detaching the detachable part of the strap from the container at the second container location and moving the strap away from the support to disengage the container from the support.

39. The method of engaging and disengaging a container for laundry related items to an ironing board of claim 37, further comprising the steps of providing the container with a strap having a first end and a second end; positioning the strap beneath the floor and securing the strap ends to the container so that a space is formed between the strap and the underside of the container, the opening between the strap and the underside of the container being sized to receive the support therethrough; inserting the support through said opening, so that upward and lateral movement of the container relative to the support is resisted by the strap; and pulling the container forwardly to slide the strap and container away from the support to disengage the support from the container.

40. The method of engaging and disengaging a container for laundry related items to an ironing board of claim 37, further comprising the steps of securing a strap to the underside of the container to form a pocket, the pocket being sized to receive the support therein; inserting the support within the pocket, to resist upward, lateral, and rearward movement of the container relative to the support; and pulling the container forwardly to slide the pocket and container away from the support to disengage the support from the container.

41. The method of engaging and disengaging a container for laundry related items to an ironing board of claim 40, further comprising the steps of providing the strap with a front edge and two side ends, and securing the front strap edge along the front of the underside of the floor of the container; and securing each strap end to the container.

42. The method of engaging and disengaging a container for laundry related items to an ironing board of claim 38, further comprising the steps of:

providing the second detachable part of the strap with a fastener secured thereto;

providing the container with a latch located at the second container location, which latch matches with the fastener;

securing the strap fastener to the latch to hold the container to the support; and unlatching the fastener from the latch and disengaging the strap from the support.

43. The method of engaging and disengaging a container for laundry related items to an ironing board of claim 42, further providing the strap fastener and the latching member on the container to comprise loop and hook fastening material.

44. The method of engaging and disengaging a container for laundry related items to an ironing board of claim 42, further comprising providing the fastener as a first snap member affixed to the strap, and the latch as a corresponding second snap member secured to the container and shaped to latch with the first snap member, the step of latching the snap members together to hold the fastener strap to the container and hold the container to the support, and the step of unfastening the snap members from each other and removing the container from the support.

45. The method of engaging and disengaging a container for laundry related items to an ironing board of claim 42, further including the steps of providing one of the strap or the container with a button secured to the strap or container, and providing the other of the strap or container with an opening corresponding to the size of the button; inserting the button through the opening to latch the second strap part to the second container location; and unfastening the strap from the button and disengaging the strap from the button.

* * * * *